US005395143A

United States Patent [19]

Chesterton

[11] Patent Number: 5,395,143

[45] Date of Patent: Mar. 7, 1995

[54] POST ASSEMBLY PERMITTING ONLY LIMITED OPENING OF A PORTAL

[75] Inventor: Frank T. Chesterton, Harrow, Canada

[73] Assignee: John K. Forrest, Colchester, Canada

[21] Appl. No.: 93,890

[22] Filed: Jul. 20, 1993

[51] Int. Cl.[6] ..... E05C 5/02

[52] U.S. Cl. ..... 292/57; 292/DIG. 15

[58] Field of Search ..... 292/60, 62, 57, 183, 292/189, DIG. 15, 58, DIG. 19

[56] References Cited

U.S. PATENT DOCUMENTS

| | | | |
|---|---|---|---|
| 1,631,370 | 6/1927 | Gillette | 292/57 |
| 3,078,704 | 2/1963 | Rifkin | 292/57 X |
| 3,330,585 | 7/1967 | Pollin | 292/DIG. 15 X |
| 4,343,500 | 8/1982 | Steiner | 292/DIG. 15 X |
| 4,462,623 | 7/1984 | Grant | 292/DIG. 15 X |
| 5,018,241 | 5/1991 | Baines | 292/DIG. 15 X |
| 5,120,093 | 6/1992 | Carney | 292/DIG. 15 X |

*Primary Examiner*—Rodney M. Lindsey
*Attorney, Agent, or Firm*—Krass & Young

[57] ABSTRACT

A locking assembly consisting of a post device is positionable in floor adjacent to a door permitting the door to be no more than partially opened. The locking assembly comprises a base fixture permanently mounted in the floor, and a post in the base assemmbly which can be raised so as to block the door against being completely opened, or lowered to permit the door to be completely opened. The locking member is releasably coupled within the fixture by means of a post connection. The post is raised or lowered by turning the post clockwise or counterclockwise until a pin located at the bottom of the post engages with a slot in the post thereby permitting the post to raised or lowered.

4 Claims, 2 Drawing Sheets

POST ASSEMBLY PERMITTING ONLY LIMITED OPENING OF A PORTAL

BACKGROUND AND OBJECTS OF THE INVENTION

The present invention relates to security locks for building portals such as doors.

It is desirable to be able to secure a door against unauthorized entry, while still being able to open the door enough to view/inspect a person or speak to them. Door chains perform that function, but are subject to being dislodged by strong pressure exerted against exterior of the door. That is, the chain is attachable between a pair of fixtures which are screwed to the door and door jam. The screws are oriented horizontally, i.e. parallel to the direction of the external impact applied to the door. Subsequently the screws can be pulled from their holes under the force of the impacts.

It is therefore, the object of the present invention to minimize or obviate shortcomings of the type discussed above.

In addition, another object is to provide a locking device for a building portal, such as a door, which enables the door to be opened only slightly and yet is highly resistant to external forces applied to the door.

SUMMARY OF THE INVENTION

These and other functions and objects are achieved by the present invention by means of a locking assembly adapted to be located in a surface adjacent to the inside of a portal, such as a door, to limit the distance by which the portal can be opened. The locking assembly comprises a base plate including a hole therein. A post is raised or lowered in the hole to secure the portal or permit the portal to open and travel freely there across. The fixture is constructed (sized) to permit the post to be raised or lowered in the hole in the base plate so as to project beyond the fixture when raised to sufficiently lie in the path of the travel direction of the portal. The fixture (base) and locking member (post)include mutually engageable coupling means enabling the locking member to be moved to a first position preventing longitudinal movement of the locking member out of blocking relationship with the portal and to a second position enabling the locking member (post) to be longitudinally lowered thereby out of blocking relationship with the portal.

BRIEF DESCRIPTION OF THE DRAWINGS

In the accompanying drawings.

DETAILED DESCRIPTION OF PREFERRED EMBODIMENTS OF THE INVENTION

Figure 1:
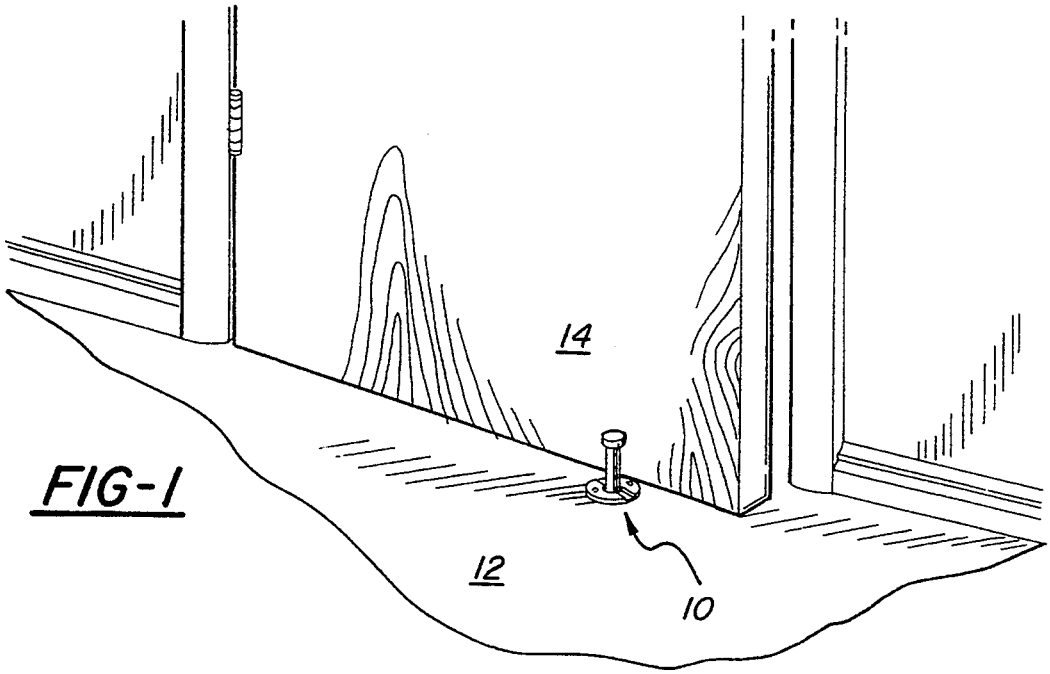
FIG. 1 is a perspective view of an interior of a room depicting a door and locking assembly with the post in the raised and locked position.
Figure 2:
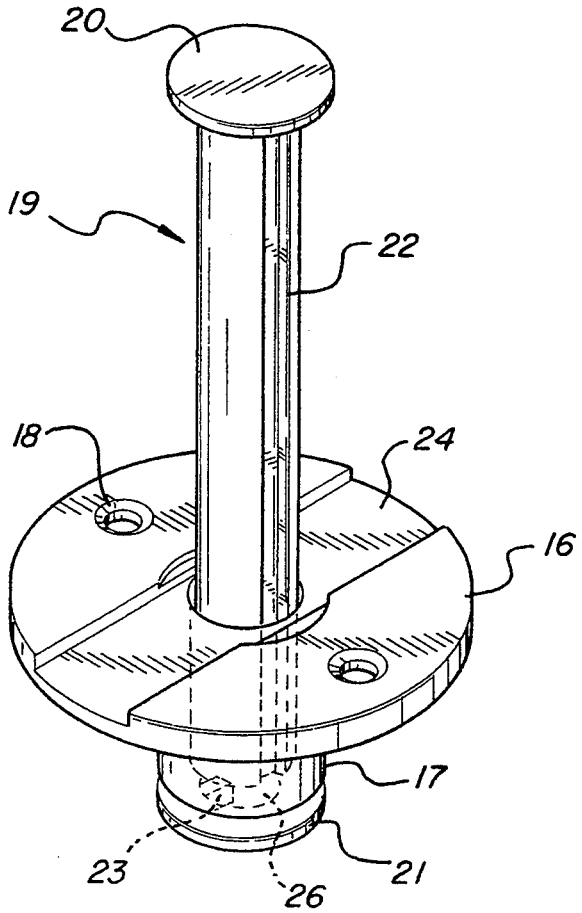
FIG. 2 is an elevational view of the locking assembly with the post in the lowered and unlocked position.
Figure 3:
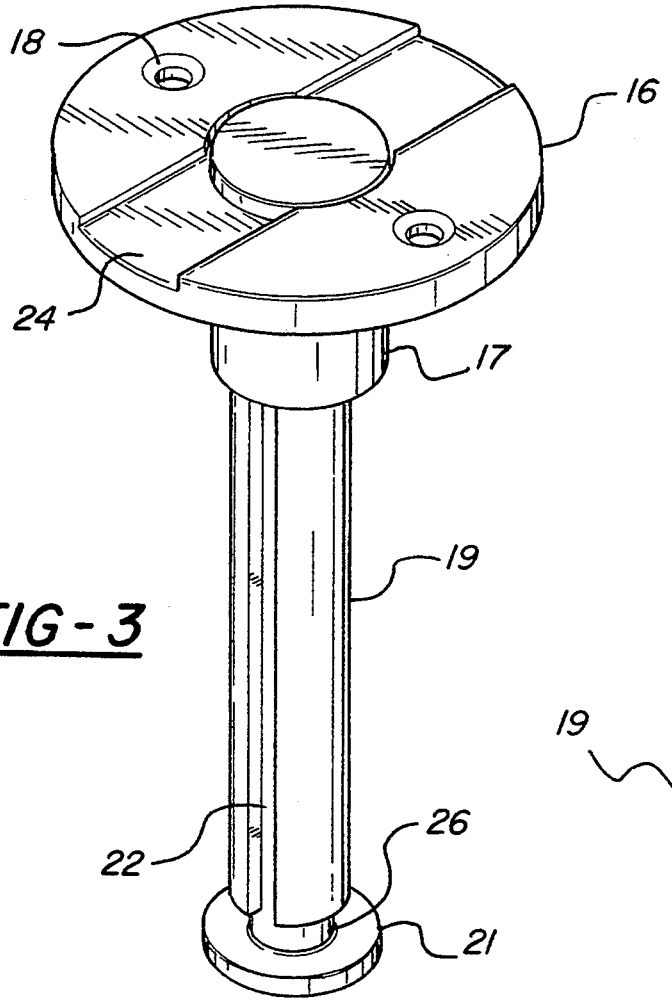
FIG. 3 is an elevational view of the locking assembly with the post in the raised and locked position.
Figure 4:
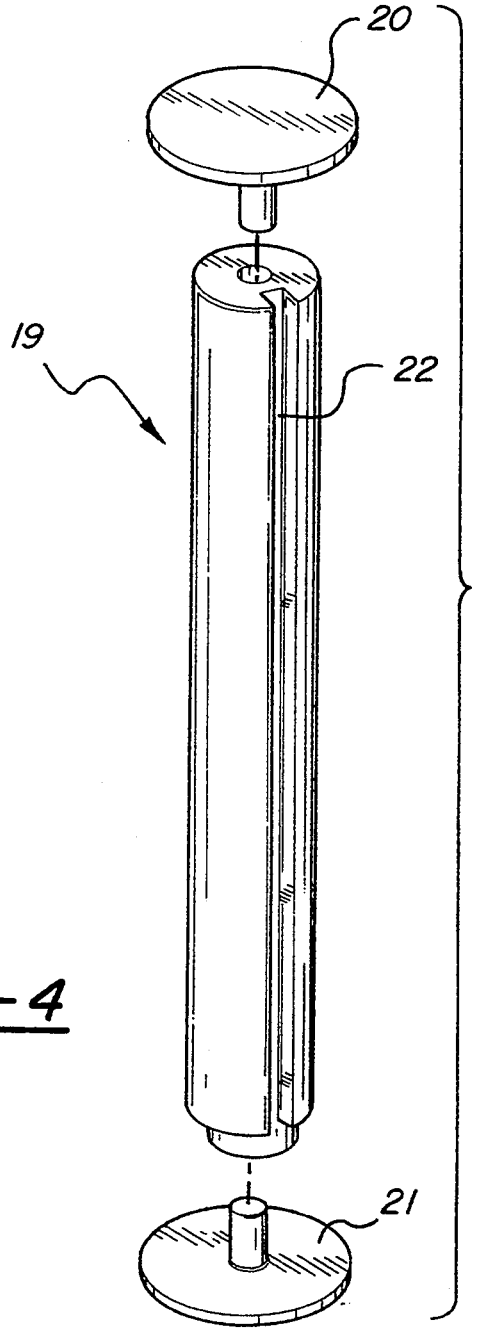
FIG. 4 is an exploded view of the post of the locking assembly depicting the top and bottom press pins.

A locking assembly 10 in accordance with the present invention is adapted to be mounted in a Floor 12 of a building at a location which allows Door 14 to be opened slightly, as depicted in FIG. 1 AND 2, and yet is highly resistant to external forces or pressure applied to the door from the exterior.

The locking Assembly 10 comprises a Base Plate 16 and a Base Plate Hub 17 depending from the Base Plate Section 16. The Base Plate Hub 17 is adapted to fit with a correspondingly sized hole in the Floor 12, such that the Base Plate 16 rests upon the Floor 12. The Base Plate 16 can be secured to the Floor 12 by means of Screws 15 extending through the Screw Holes 18 in the Base Plate Section 16 . The height of the Base Plate section 16 must be such as to allow the Door 14 to pass freely thereover when the Post 19 is lowered into the Base Plate Hub 17.

Formed in the Post 19 is a Vertical Pin Slot 22 which extends the entire length of the Post 19 and a Horizontal Pin Slot 26 which is formed around the circumference of the bottom of the Post 19.

Inserted into the top of the Post 19 is a Top Press Pin 20 which is larger than the diameter of the Post 19. Inserted in the bottom of the Post 19 is a Bottom Press Pin 21 which is larger in diameter than that of the Post 19.

Base Plate 16 has a horizontal Slot 24 in the top surface of the Base Plate 16. Also formed in the top surface of Base Plate 16 is a circular Base Plate Seat 25.

Inside the Base Plate Hub 17 is a Slot Pin 23 projecting laterally from the inner walls of the Base Plate Hub 17.

Fitting into the Base Plate Hub 17 which is a part of the Base Plate 16 is the Post 19 which can be raised or lowered in the Base Plate Hub by means of a Vertical Pin Slot 22 in the Post 19. The Post 19 can only be raised or lowered when the Post 19 is rotated until the Slot Pin 23 fits into the Vertical Pin Slot 22 thereby permitting the Post 19 to be raised or lowered.

The Post 19 is raised above the Base Plate 16 by means of grasping the Top Press Pin 20 permitted by Base Plate Slot 24 and raising the Post 19 until it is fully extended above the Base Plate 16. With the Post 19 in the raised position, to prevent the Post 19 from being lowered into the Base Plate Hub 17, the Post 19 is then rotated clockwise or counter clockwise which prohibits the Slot Pin 23 from engaging with the Vertical Pin Slot 22 in the Post 19.

To lower the Post 19 into the Base Plate Hub 17 you must grasp the Top Press Pin 20 and rotate Post 19 clockwise or counter clockwise until the Slot Pin 23 engages with the Vertical Pin Slot 22, which allows Post 19 to be lowered into the Base Hub Plate 17.

IN OPERATION, with the Base Plate 16 mounted in the Floor 12 and the Post 19 lowered into the Base Plate Hub 17 the Door 14 may be opened and closed freely thereover. Thus, the locking assembly can remain permanently secured in the floor as a fixture. When it is desired to secure the door against being fully open, the Post 19 is raised above the Base Plate 16 by means of grasping the Top Press Pin 20 permitted by Base Plate Slot 24 and raising the Post 19 until it is fully extended above the Base Plate 16. With the Post 19 in the raised position, the Post 19 is rotated clockwise or counter clockwise, which allows the Post 19 to remain in the raised position.

Consequently, the locking assembly 10 is affixed in position to enable the Door 14 to be opened only slightly. This allows the occupant to safely speak to or inspect a visitor. If a heavy external force is applied to the door, such force will be resisted by the sheer strength of the Post 19. Since the external force will be orientated generally transversely to that Post 19. Hence, the Post, fabricated of a suitably strong material, a substantial amount of resistance is achieved.

When the Door 14 is to be unlocked, the Post 19 is rotated clockwise or counter clockwise until the Slot Pin 23 engages in the Vertical Pin Slot 22 therefore allowing the Post 19 to be lowered into the Base Plate Hub 17.

Although the present invention has been described in connection with preferred embodiments thereof, it will be appreciated by those skilled in the art that additions, modifications, substitutions, and deletions not specifically described, may be made without departing from the spirit and scope of the invention as defined in the appended claims.

What I claim is:

1. A locking assembly adapted to be located on a floor adjacent a door to limit the distance by which the door can be opened comprising:

a base plate having an orifice therein and a sleeve depending therefrom, said sleeve being in registry with said orifice and adapted to be insertable into a correspondingly sized hole in the floor and said base plate being sized to permit the door to travel freely thereacross;

a post longitudinally insertable into the orifice and sleeve and freely hand movable between a locking position wherein said post projects sufficiently above the base plate as to lie in the path of travel of the door and a non-locking position wherein said post is freely lowered by gravity to permit the door to travel freely thereacross; and a circumferential slot portion near the bottom of the post and a vertical slot portion communicating with said circumferential slot portion and wherein the sleeve includes a laterally projecting slot pin, said slot pin adapted to fit and travel within said slot portions in response to a combination of vertical and rotational movement of the post, said circumferential slot maintaining the post in the locking position when said pin is located therein and said vertical slot portion permitting the post to retract to the non-locking position by gravity when said pin is located therein.

2. A locking assembly according to claim 1 wherein the post further includes a top press pin at an upper end of the post, said top press pin having a head which is greater in diameter than the post and orifice and a bottom press pin at a lower end of the post, said bottom press pin having a head which is greater in diameter than the post and orifice.

3. A locking assembly according to claim 2 wherein the base plate has a finger slot means to permit the grasping of the top press pin and thereby permitting the lifting and rotating of the post to the locking position.

4. A locking assembly adapted to be located on a floor adjacent a door to limit the distance by which the door can be opened comprising:

a base plate having an orifice therein and a sleeve depending therefrom, said sleeve being in registry with said orifice and adapted to be insertable into a correspondingly sized hole in the floor and said base plate being sized to permit the door to travel freely thereacross;

a post longitudinally insertable into the orifice and sleeve and freely hand movable between a locking position wherein said post projects sufficiently above the base plate as to lie in the path of travel of the door and a non-locking position wherein said post is freely lowered by gravity to permit the door to travel freely thereacross; and a first engagement means near the bottom of said post and a second engagement means in said sleeve adapted to engage said first engagement means to maintain the post in the locking position said first and second engagement means being disengageable to permit the post to retract to the non-locking position by gravity.

* * * * *